US005125123A

United States Patent [19]

Engle

[11] Patent Number: 5,125,123

[45] Date of Patent: Jun. 30, 1992

[54] SLEEP COMFORTER LEG PILLOW

[76] Inventor: Lawrence J. Engle, 4844 Lehigh Dr., Springfield, Ohio 45503

[21] Appl. No.: 696,614

[22] Filed: May 7, 1991

[51] Int. Cl.[5] ..... A47C 20/02

[52] U.S. Cl. ..... 5/648

[58] Field of Search ..... 5/443

[56] References Cited

U.S. PATENT DOCUMENTS

| | | | |
|---|---|---|---|
| 4,266,298 | 5/1981 | Graziano | 5/443 X |
| 4,371,985 | 2/1983 | Pokhis | 5/443 X |
| 4,392,489 | 7/1983 | Wagner, Sr. | 5/443 X |
| 4,624,021 | 11/1986 | Hofstetter | 5/443 X |
| 4,805,605 | 2/1989 | Glassman | 5/443 X |
| 4,910,818 | 3/1990 | Grabill et al. | 5/443 |
| 4,982,745 | 1/1991 | Shields | 5/443 X |

FOREIGN PATENT DOCUMENTS

| | | | |
|---|---|---|---|
| 3045714 | 12/1982 | Fed. Rep. of Germany | 5/443 |

*Primary Examiner*—Renee S. Luebke
*Assistant Examiner*—Michael J. Milano
*Attorney, Agent, or Firm*—Fleit, Jacobson, Cohn, Price, Holman & Stern

[57] ABSTRACT

The sleep comforter is a cushion which is especially designed to support and position the user's lower legs during sleep or prolonged bed rest. The sleep comforter restricts the user from sleeping in awkward uncomfortable sleeping positions, while still allowing the user the ability to easily change from one comfortable sleeping position to a wide range of alternative comfortable sleeping positions.

3 Claims, 1 Drawing Sheet

SLEEP COMFORTER LEG PILLOW

BACKGROUND OF THE INVENTION

1. Field of Invention

This invention relates in general to sleeping comfort and in particular to positioning and supporting the user's lower legs during sleep in a way that will restrict the user from sleeping in awkward uncomfortable sleeping positions, while still allowing the user the ability to easily change from one comfortable sleeping position to a wide range of alternative sleeping positions.

2. Description of Prior Art

Many people will experience stiffness and pain in their lower back, hips, shoulders and various other areas of their body after a night of sleeping in uncomfortable awkward sleeping positions.

When a person lies flat on her back with her knees straight, the weight of her legs will push down on the hip joints which will result in pressure and stress on the hip joints. When the hip joints are pushed downward, the part of the hip that connects to the lower spine is tilted upward which creates a small reverse curvature of the lower spine. The reverse curvature of the lower spine creates pressure and stress in the lower back area. A cushion under the knees of a person who is sleeping on her back will support the weight of the sleeper's legs and will alleviate the downward pressure on the sleeper's hip joints. When the downward pressure on the hip joints is alleviated, then there will not be any upward pressue where the hips and lower spine connect. The lack of upward pressure on the lower spine will allow the lower spine to stay in a more relaxed and comfortable sleeping position. The problem with placing an ordinary cushion underneath the sleeping person's knees is that during sleep the cushion will become dislodged as the sleeper occasionally changes sleeping positions.

When a person sleeps on her side with her knees together, the weight of the upper leg creates pressure and stress on the hip joints. A cushion placed in between the knees of a person sleeping on her side will support the weight of the top leg which will relieve stress and pressure on the hip joints. The problem with placing an ordinary cushion between the knees of a person sleeping on her side is that the cushion will become dislodged as the sleeper occasionaly changes sleeping positions.

Even the most comfortable sleeping positions will result in stiffness and pain if the sleeping person does not occasionally change positions during a night of sleep. The Sleep Comforter will not only restrict the user to sleeping in only comfortable sleeping positions, but just as importantly it gives the user the ability to exercise and relax muscles and joints during sleep by allowing the user the ability to easily move from one comfortable position to a wide range of alternative comfortable sleeping positions.

The Sleep Comforter can be used by anyone who experiences stiffness and pain after bed rest, but should be especially comforing for women in their 3rd trimester of pregnancy. The additional weight and pressure caused by the pregnancy can create extra stress and pressure on the lower back and hip joints during bed rest.

Whatever the precise merits, features, and advantages of the cited references, none of them achieves or fulfills the purposes of the Sleep Comforter. A patent search revealed several inventions used to improve sleeping positions. The relative art fails to provide an apparatus which supports and positions the user's lower legs during bed rest, while still allowing the user the freedom to easily move in and out of a wide variety of comfortable sleeping postions.

The prior art which is most similiar to my invention, the Sleep Comforter, is called the "Leg Positioning Assembly", U.S. Pat. No. 4,910,818. The Leg Positioning Assembly is a cushion which fits under, around, and in between the user's legs from the middle thigh area to the middle calf area. The Leg Positioning Assembly immobilizes the user's hip joints and knee joints which would be preferred for a patient who has a hip or knee injury, but would not be preferred for someone who wants to relieve pain and stiffness caused during sleep or prolonged bed rest. Movement of muscles and joints is necessary to prevent stiffness and pain in muscles and joints during sleep or prolonged bed rest.

My invention, the Sleep Comforter, fits under, around and in between the user's lower legs from just below the user's knee joints to just above the user's ankles. Because the Sleep Comforter attaches below the knee joints, it is conducive for the user to change the position of their knee joints and hip joints during sleep or prolonged bed rest. Since the user of the Sleep Comforter can change the position of their knee joints and hip joints, the user can exercise and relax their muscles and joints, which will provide a more restful sleep and alleviate stiffness and pain in their muscles and joints after sleep or prolonged bed rest.

SUMMARY OF THE INVENTION

The sleep Comforter is a cushion which is especially designed to support and position the user's lower legs during sleep or prolonged bed rest.

It is an objective of the inventioin to provide a lightweight apparatus which will support and position the user's lower legs during sleep or prolonged bed rest while still allowing the user the ability to easily change from one comfortable sleeping position to a wide range of alternative comfortable sleeping positions.

It is another objective of the invention to allow the user the ability to quickly and easily engage or disengage from the apparatus.

It is another objective of the invention to provide an apparatus which will relieve stress and pain in the hip joints during sleep or prolonged bed rest.

It is another objective of the invention to provide an apparatus which will relieve stress and pain in the lower back area during sleep or prolonged bed rest.

The lower base portion of the Sleep Comforter cushion will fit underneath the user's lower legs and will support the weight of the user's legs. The top portion of the Sleep Comforter cushion contains leg grooves which will position and control certain movements of the user's legs.

The lower base portion of the Sleep Comforter cushion is especially designed to allow the user the ability to easily change from one comfortable sleeping positioin to a wide range of alternative comfortable sleeping positions. The user of the Sleep Comforter can change the angle of her knees and hip joints to a wide variety of positions ranging from having her knees in a straight position with her feet extended to tight tucked position with her knees pulled back toward her buttock. Also the user of the Sleep Comforter can easily change from lying on her back to lying on either side by merely rolling to her left or rolling to her right.

The preferred embodiment of the Sleep Comforter is made from a lightweight inflatable thermoplastic which makes the Sleep Comforter extremely lightweight. Because the Sleep Comforter is lightweight and especially designed to allow the user the ability to easily change sleeping positions, the user of the Sleep Comforter can unconsciously change sleeping positions without disturbing their sleep. Also the user of the Sleep Comforter can change sleeping positions while still remaining in the same location of the bed. This advantage allows the user of the Sleep Comforter the ability to change sleeping positions in a single size bed without rolling out of bed, or to share a double size bed and change sleeping positions without disturbing her bed mate.

The Sleep Comforter cushion comprises a cushion and contains leg grooves which should be large enough for the user to easily engage or disengage from the cushion. For those people who are unusually restless sleepers who might accidently kick their legs out of the leg grooves during sleep, a covering for the invention can be used which has attachment straps across the leg groove slots which help hold the user's legs in the leg grooves. The preferred attachment method for the attachment straps would be velcro, hook, and loop fastener which can be removed easily with just one hand, which still allows the user quick and easy engagement or disengagement from the invention.

The lower base portion of the cushion supports the weight of the user's legs which will eliminate the downward pressure on the user's hip joints. By removing the downward pressure on the hip joints the cushion will relieve stress and pain in the hip joints during sleep or prolonged bed rest.

Because the cushion will eliminate the downward pressure on the hip joints, it will subsequently also eliminate the upward pressure on the lower back. By removing the upward pressure on the lower back, the cushion will relieve stress and pain in the lower back during sleep or prolonged bed rest.

These objectives, advantages, and features of the cushion will be explained in more detail hereinafter.

BRIEF DESCRIPTION OF THE DRAWINGS

There are shown in the drawings embodiments which are presently preferred it being understood, however that the invention is not limited to the precise size and shape shown, where in.

DETAILED DESCRIPTION OF THE INVENTION

Figure 1:
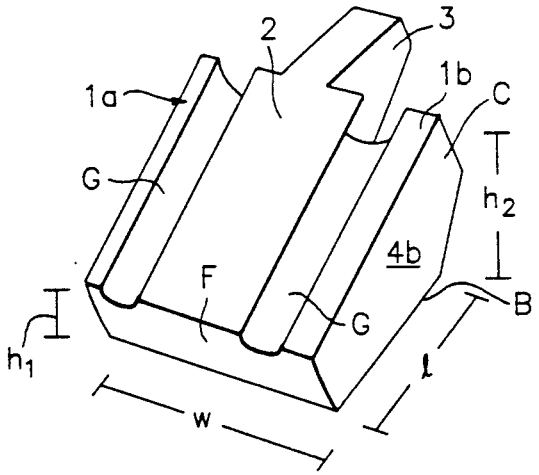
FIG. 1 is a top perspective view of the front, left side, and top faces of the preferred embodiment of the invention.
Figure 2:
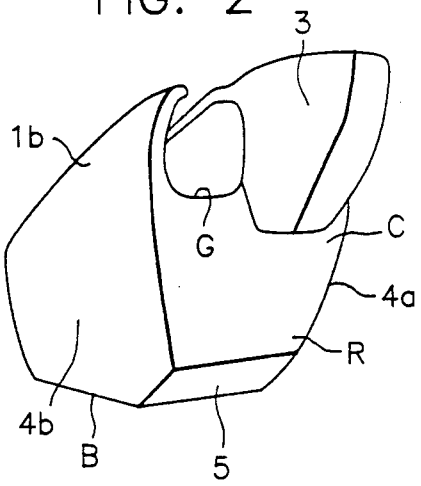
FIG. 2 is a top perspective view of the rear and left side faces of the preferred embodiment of the invention.

Refer now to FIGS. 1 and 2, the cushion C includes a front end F, a rear end R and a forwardly and downwardly inclined top surface T as well as side faces 4*a* and 4*b* and a bottom surface B. The dimensions of the lower portion of the cushion C can vary, but, in general, the preferred width (w) shall be approximately the same distance as the width of the user's hips. The preferred length (l) shall be slightly less than the distance between the user's ankles and their knees. The preferred height ($h_1$) of the front leg grooves G shall be approximately the same distance as the distance between the user's ankles and the heels of their feet. The preferred height ($h_2$) of the back leg grooves G above the bottom surface B shall be slightly less than the distance between the user's buttock and thier knees.

The dimensions and shape of the top portion of the cushion C can vary, but, in general, the outer lobe cushion sections (1*a*) and (1*b*) combined with the leg separation cushion section (2) will form two leg grooves G inclined generally 45 degrees relative the bottom surface B. The leg grooves G are substantially straight and can have variety of different shapes, but the preferred embodiment will have circular shaped leg grooves which are not completely enclosed at the top. The preferred size of the leg grooves G shall have a diameter larger than the diameter of the largest part of the user's lower leg L. The remaining part of the top portion of the cushion C is the knee separation cushion section (3). The knee separation cushion section (3) can vary in size and shape, but the preferred embodiment will have a knee separation cushion (3) which extends beyond the back portion of the leg separation cushion section (2) and extends part way down the back face of the cushion C. The knee separation cushion section (3) shall be large enough to comfortably support the entire knee area of the top leg when the user is lying on either side.

Refer now to FIG. 2, which is a perspective view of the side, back, and lower inclined lateral faces of the preferred embodiment of the invention. The side faces (4*a*) and (4*b*) can vary in shape, but the preferred shape of the side faces (4*a*) and (4*b*) will be slightly convexed. The convexed shape of the side faces (4*a*) and (4*b*) will allow the user easy mobility to change sleeping positions from lying on their back to lying on either side.

Figure 5:
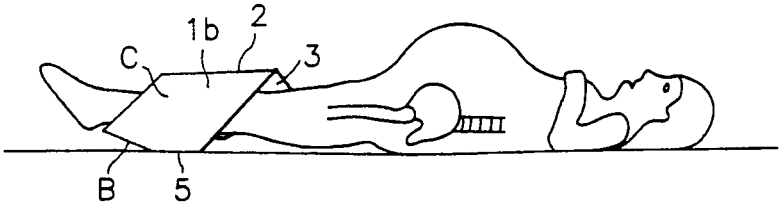
FIG. 5 is a side view of a pregnant woman's legs, hips, and lower back while lying on her back, using the invention with her knees in a straight position.

The lower inclined lateral face (5) can vary in size and shape, but the preferred lateral face (5) will be rectangular in shape and parallel to the slope of the leg grooves G. The lower inclined lateral face will become the bottom surface of the invention when the user extends her feet away from her buttock as depicted in FIG. 5.

The cushion C can be made from any firm lightweight material, but the preferred embodiment will be made from a lightweight inflatable thermoplastic. The method for producing the cushion C can vary but the preferred process for producing the cushion C will be a rotational mold. Because the preferred embodiment is made from a lightweight thermoplastic filled with air, the preferred embodiment of the cushion C will be extremely lightweight, but still firm enough to position and support the user's lower legs.

Figure 3:
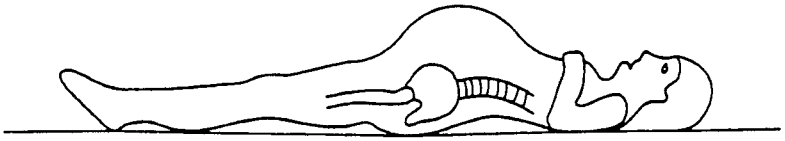
FIG. 3 is a side view of a pregnant woman's legs, hips, and lower back, while lying on her back without using the invention.

Refer now to FIG. 3, which is a drawing of a pregnant woman lying on her back with her knees in a straight position. The weight of the woman's legs creates a downward pressure on the lower portion of the hips at the hip joints. The downward pressure on the lower portion of the hips will create a teeter totter effect on the hips which will create an upward pressure on the top of the hips where the hips connect with the lower spine. The upward pressure on the lower spine will result in a slightly upward curvature of the lower spine which results in stress and pressure on the muscles of the lower back. The additional weight and pressure caused from pregnancy will also add to the stress and pressure on the muscles of the lower back.

Figure 4:
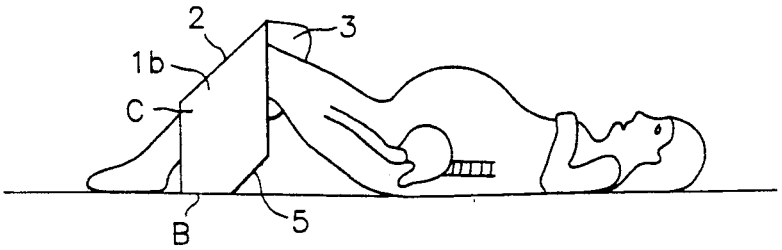
FIG. 4 is a side view of a pregnant woman's legs, hips, and lower back while lying on her back, using the invention with her knees in a bent position.

Refer now to FIG. 4, which is a drawing of a pregnant woman lying on her back while using the invention. The weight of the woman's legs are supported by the cushion C which will relieve stress an pain in the user's hip joints during sleep or prolonged bed rest. By eliminating the downward pressure on the hip joints, it will eliminate the upward pressure where the top of the hips connect to the lower spine. Since the upward pressure on the lower spine is eliminated, the lower spine will remain in a more relaxed and comfortable curvature which will relieve stress and pain in the user's lower back area during sleep or prolonged bed rest.

Refer now to FIG. 5, which is a drawing of a pregnant woman lying on her back, while using the cushion C with her knees in a straight position. The lateral face (5) is now positioned at the bottom where the invention contacts the bed surface and the lower legs are elevated to a position which would be parallel to the surface of the bed. The weight of the user's lower legs is still supported by the invention, but the angle of the knee joints and hip joints has been changed. The ability of the user to change the position of her knee and hip joints will give the user needed exercise and movement in her knee and hip joints which will relieve stiffness and pain during sleep or prolonged bed rest.

Figure 6:
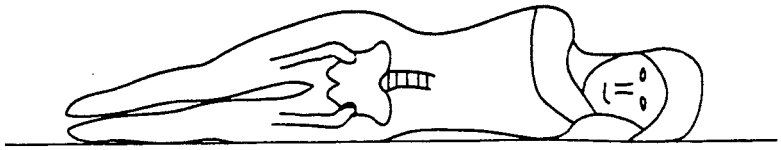
FIG. 6 is as front view of a pregnant woman's legs, hips, and lowe back, while lying on her side without using the invention.

Refer now to FIG. 6, which is a drawing of a pregnant woman lying on her side with her knees together. The weight of her top leg will push downward on her hip joint which causes stress and pressure on her hip joint. The downward pressure on the top hip joint will subsequently create an upward pressure on the lower spine which will create stress and pressure in the lower back area.

Figure 7:
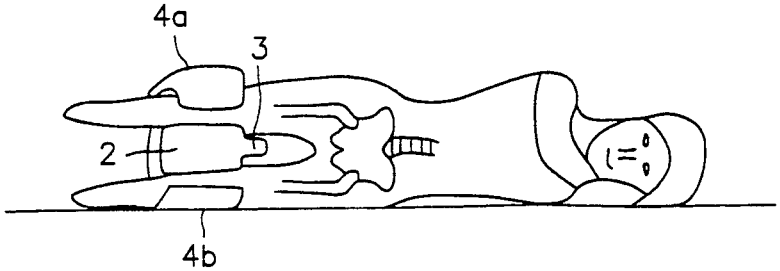
FIG. 7 is a front view of a pregnant woman's legs, hips, and lower back, while lying on her side using the invention.

Refer now to FIG. 7, which is a drawing of a pregnant woman lying on her side while using the invention. Her legs are still positioned in the leg grooves and the weight of the top leg is supported by the leg separation cushion section (2) and the knee separation cushion section (3). Because the weight of the top leg is supported by the invention, the stress and pressure on the hip joint is eliminated. Because the downward pressure is removed from the hip joint, subsequently the upward pressure on the lower spine is eliminated. Since the pressure on the hip joint and lower spine is eliminated, the user will relieve stress and pain in the hip joints and lower back area during sleep or prolonged bed rest. Because the preferred embodiment of the invention is extremely lightweight and its side faces (4*a*) and (4*b*) are convexed in shape, the user of the cushion C can easily change to a variety of comfortable sleeping positions from lying on her back to lying on either side.

In conclusion, cushion C is a cushion which fits under, around, and in between the user's lower legs and knees. The cushion C is an apparatus for positioning and supporting the user's lower legs in a way that will restrict the user from sleeping in awkward uncomfortable sleeping positions, while still allowing the user the ability to easily change from one confortable sleeping position to a wide range of alternative comfortable sleeping positions.

The invention having thus been described, the following is claimed:

1. An elongated cushion for fitting under, around and between the lower legs of a person reclining on a bed, said cushion including front and rear ends and opposite longitudinal side faces as well as a bottom surface and a forwardly and downwardly inclined top surface, said cushion defining two substantially straight longitudinal lower leg receiving grooves formed therein generally paralleling and opening upwardly through said top surface as well as endwise outwardly through said front and rear ends and being spaced apart laterally of said cushion and inwardly from said side faces, the lower open ends of said grooves being spaced slightly above said bottom surface, the portion of said cushion disposed between said grooves defining a central leg separation cushion section and the portions of said cushion disposed to the remote sides of said grooves defining two outer lobe cushion sections each serving to space the adjacent leg groove from a bed surface when the corresponding cushion longitudinal side face is resting on said bed surface, said cushion also including a central knee separation cushion section disposed between said grooves and projecting upwardly beyond the upper ends of said grooves and rearwardly of said rear end for reception between the knees of a person whose lower legs are disposed in said grooves, the length of said grooves being equal, generally, to slightly less than the distance between a persons knees and his or her ankles, said grooves being inclined generally 45 degrees relative to said bottom surface and being generally C-shaped in cross section with the portions of said grooves opening upwardly through said top surface being of less width than the mid-height portions of said grooves whereby a person's lower therein are releasably retained against casual removal therefrom.

2. The cushion of claim 1 wherein side faces are slightly convexed.

3. The cushion of claim 1 wherein said bottom surface and said rear end are joined by a lower inclined lateral face of said cushion disposed at generally 45 degrees relative to said bottom surface.

* * * * *